United States Patent [19]

Kalmanides

[11] Patent Number: 4,771,934

[45] Date of Patent: Sep. 20, 1988

[54] FOOD TRAY WITH LID LOCKING MECHANISM

[75] Inventor: Danny Kalmanides, Orange, Conn.

[73] Assignee: Inline Plastics Corp., Milford, Conn.

[21] Appl. No.: 34,616

[22] Filed: Apr. 6, 1987

[51] Int. Cl.[4] ..... B65D 1/34

[52] U.S. Cl. ..... 229/2.5 R; 24/702; 206/470; 220/4 B; 220/306

[58] Field of Search ..... 206/470, 461; 220/306, 220/307, 339, 4 B, 4 E; 229/2.5 R, 43, 44 R, 45 R; 24/700–702

[56] References Cited

U.S. PATENT DOCUMENTS

| | | | |
|---|---|---|---|
| 3,351,270 | 11/1967 | Hohnjec | 220/306 X |
| 3,786,982 | 1/1974 | Rakes et al. | 229/2.5 R |
| 4,132,344 | 1/1979 | Jewell | 229/2.5 R |
| 4,183,446 | 1/1980 | Davis | 220/306 |
| 4,193,496 | 3/1980 | Barratt | 229/2.5 R X |
| 4,319,684 | 3/1982 | Backman et al. | 206/470 X |
| 4,512,474 | 4/1985 | Harding | 206/470 X |
| 4,576,330 | 3/1986 | Schepp | 229/44 R |

*Primary Examiner*—Stephen Marcus
*Assistant Examiner*—Bryon Gehman
*Attorney, Agent, or Firm*—Kramer, Brufsky & Cifelli

[57] ABSTRACT

The present invention provides a one-piece plastic thermo-formed foodtray with a lower tray portion which may be closed by a folding upper lid portion. The lid portion is locked over the tray portion by the interlocking of interior upright cylindrical elements formed from a flange about the periphery of the tray portion into exterior upright cylindrical elements formed from a flange about the periphery of the tray portion. Raised lands are provided adjacent to the exterior upright cylindrical elements in order to protect the same from pressure and subsequent degradation and deformation during the interlocking process by limiting the depth of depression with the thumb of the interlocking cylindrical elements.

12 Claims, 2 Drawing Sheets

FOOD TRAY WITH LID LOCKING MECHANISM

BACKGROUND OF THE INVENTION

1. Field of the Invention

This invention relates to a folding plastic food tray with a locking mechanism wherein raised lands are used to prevent direct pressure on and the subsequent degradation of the mechanism.

2. Description of the Prior Art

It is well-known that food has been sold by "fast-food" restaurants in carry-out containers consisting of a thermoformed plastic tray provided with a hinged lid. The lid includes a flange which has been heretofore seated in snap arrangement with a horizontal flange integrally molded about the rim portion of the food-carrying tray. Attempts to hold the lid in a closed position on the flange about the rim portion of the tray while maintaining the ability to repeatedly open and close the tray without any degradation to the locking mechanism, have generally proved unsuccessful.

Such attempts have taken the form of providing an upstanding or vertical wall about the perimeter or periphery of the horizontal flange on the rim portion of the tray wherein the distance between opposed portions of the upstanding wall has been slightly less than the distance between corresponding portions of the mating flange on the lid so that the flange on the lid is engaged between opposed portions of the vertical wall on the perimeter of the horizontal tray flange in tight, snap engagement. Because of the resiliency inherent in the hinge attaching the lid to the tray, the lid has not been held in place in snap engagement between opposite portions of the vertical wall. Further, because of the materials, such as plastic, used to form the tray, the distances between opposite portions of the upstanding wall and corresponding portions of the horizontal flange on the lid have been imprecise, therefore failing to effect snap engagement of the lid between opposite portions of the upstanding wall.

In order to remedy this, interlocking upright cylindrical elements have been formed on the horizontal flanges of the lid and tray. However, imprecision in the formation of the interlocking cylindrical elements and the inherent resiliency in the hinge of the lid prevented this from being a satisfactory massproduced locking mechanism.

U.S. Pat. No. 4,576,330, issued to Schepp and having a common assignee as the instant invention, discloses a folding plastic foodtray with interlocking male and female elements formed on the horizontal flange of the lid and tray. A snap, reversible locking engagement is realized by providing the male element with an enlarged diameter portion at its closed top end which is received in snap engagement past a smaller diameter annular rim formed in the opening to the bore of the female element. This configuration, however, has proven somewhat unsatisfactory in that in order to engage the male and femle elements in snap, reversible locking engagement, one must press directly upon the male and female elements. In both this particular design and any other design using interlocking male and female elements, after the foodtray is repeatedly opened and closed, this pressure on the cylindrical elements causes these elements to deform thereby degrading the reliability of the locking arrangement.

It is therefore an object of the present invention to provide a means whereby various designs of interlocking male and female elements, not limited to the above-described design of the Schepp patent, locking the folding lid to a foodtray are not subjected to direct deforming pressure in the engaging of this interlocking arrangement. This allows the repeated engagement and disengagement of the interlocking arrangement without any degradation thereto.

SUMMARY OF THE INVENTION

The present invention provides an apparatus whereby a foodtray may have a folding lid secured thereto by the use of male and female interlocking upright cylindrical elements but without the degradation of the interlocking mechanism due to the repeated locking and unlocking thereof.

One or more upright cylindrical female elements are formed at appropriate locations about the periphery of the lid. Interlocking upright cylindrical male elements are formed about the periphery of the tray in locations in which they extend into the upright cylindrical female elements when the lid is in a closed position over the tray. One skilled in the art will realize that many variations of the cylindrical shape may be used to enhance the strength of the interlocking mechanism.

In order to provide a means in which the user can firmly snap the male elements into the female elements, lands or raised portions are formed near the base of the upright cylindrical element and extend to approximately the height of the female cylindrical elements. This allows the user to push on these lands in combination with the upright cylindrical female elements when closing the lid thereby limiting deformation and preserving the shape, resiliency and functionality of the interlocking upright cylindrical elements through repeated use.

Whenever the user wishes to lock the lid to the tray, he places the tip of the upright cylindrical male element into the corresponding upright cylindrical female element. He places his forefinger under the upright cylindrical male element on the periphery of the tray. Then he places his thumb over the lands in combination with the upright cylindrical female elements on the lid and presses his thumb and forefinger together thereby interlocking the upright cylindrical elements one to another. If the user presses on a combination of the interlocked elements and lands, the depth of depression of the thumb and hence, the interlocked elements is limited by contact with the lands, thereby preserving the integrity of the interlocking elements for repeated use.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
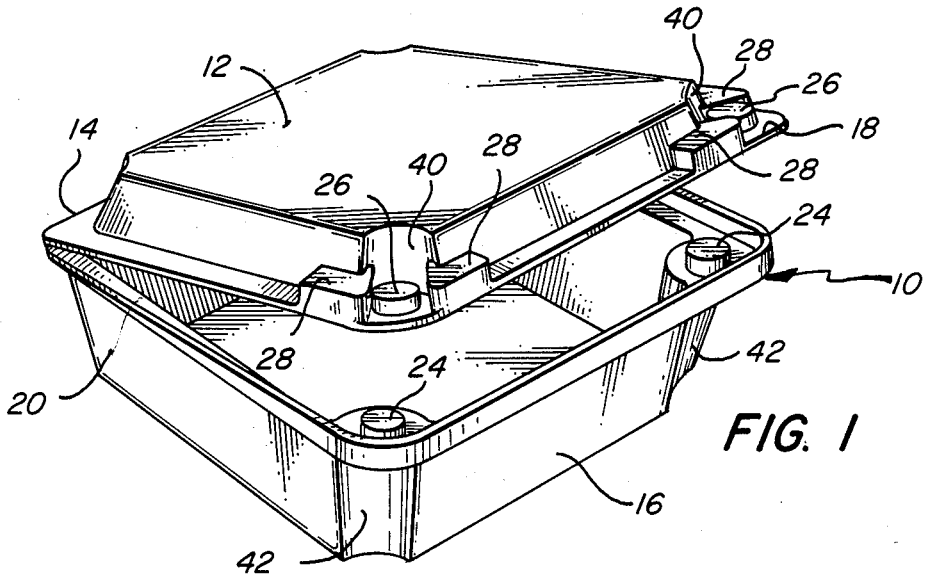
FIG. 1 is a perspective view of one form of an open food tray of the present invention which is provided with a lockable hinged lid.
Figure 2:
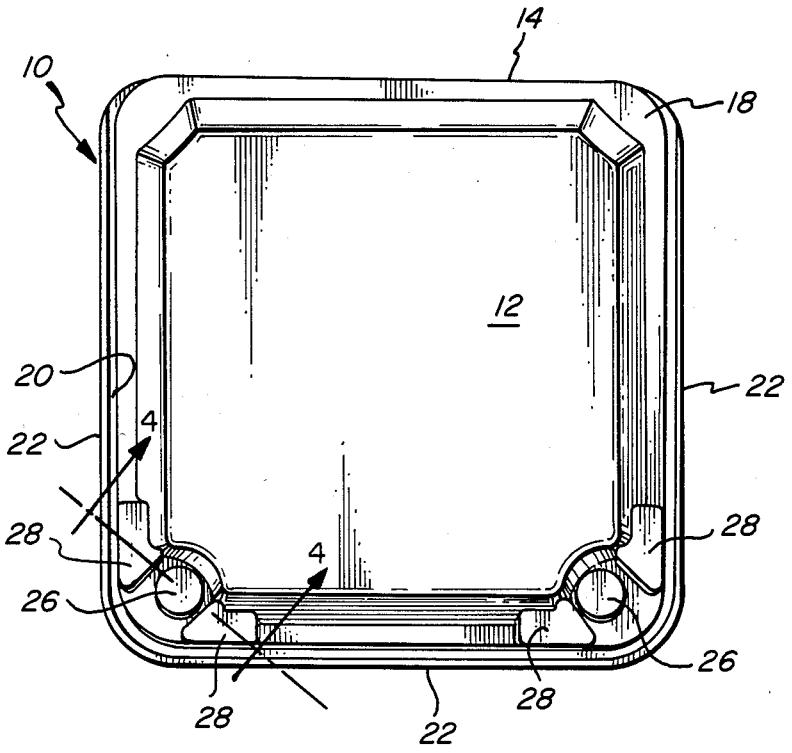
FIG. 2 is a top plan view of the lidded food tray of FIG. 1.

Referring now to the drawings in detail wherein like numerals indicate like elements throughout the several views, one form of the food tray 10 of the present invention may be thermoformed by an apparatus and process illustrated and described in U.S. Pat. No. 4,382,762 issued on May 10, 1983 to Schepp, and is shown in FIGS. 1 to 5, inclusive. In general, the food tray 10 is thermoformed in a mold cavity in one piece having a lid 12 hinged along a line 14 directly to a tray portion 16. Tray portion 16 and lid 12 are rectangular, preferably square, in plane elevation.

The lid 12 of the apparatus 10 is provided with a horizontal flange 18 around its periphery adapted to be seated on a horizontal flange 20 provided about the periphery of tray 16. Flange 20 is also provided with an upstanding lip 22, the distance between opposed positions thereof being less than the distance between corresponding portions of the horizontal flange 18 on lid 12 so that the lid can be held in place in a seated engagement on flange 20 when the lid is in position to close the bottom portions of tray 16.

Formed on opposing corners of the front portion of flange 20 is an upstanding hollow peg or upright cylindrical male element 24. Upright cylindrical male elements are adapted to be received in bores or upright cylindrical female elements 26 formed on corresponding locations on lid flange 18 in snap engagement to securely lock the lid 12 to the bottom portion of the apparatus or tray 16. The manner in which the male and female upright cylindrical elements 24, 26 are interlocked in snap engagement does not form a part of the present invention. For a full disclosure of the manner in which the lock engagement is effected, reference should be had to U.S. Pat. No. 4,576,330, which disclosure is incorporated herein by reference.

Adjacent to the upright cylindrical female elements 26 are raised portions or lands 28 about the periphery of the lid flange 18. These lands 28 are approximately the same height as the upright cylindrical female elements 26, and may have any shape convenient to the molding process. In the embodiment shown, the land 28 and J and L-shaped in plan.

Figure 4:
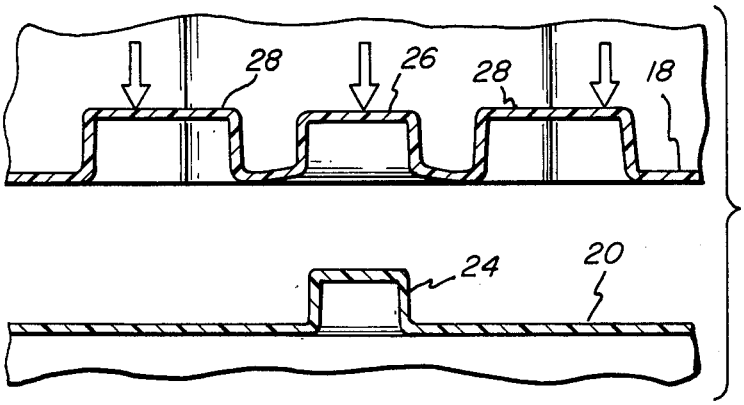
FIG. 4 is a cross-sectional view taken substantially along the plane indicated by line 4–4 of FIG. 2.
Figure 5:
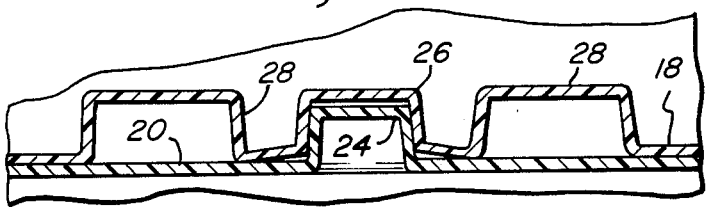
FIG. 5 is a view similar to FIG. 4 after the food tray has been closed and locked.

In order to readily effect the snap engagement between the upright cylindrical male element 24 and the upright cylindrical female element 26, the body portion of the lid 12 and the corresponding body portion of the tray 16 adjacent to the corners of the lid 12 and the tray 16 are provided with indented arcuate surface 40 and 42, respectively, for guiding the thumb and forefinger of the hand, respectively, to cause engagement of the upright cylindrical male element 24 within the corresponding upright cylindrical female element 26 in the lid 12 by applying simultaneous pressure between the thumb and forefinger to the lands 28 and the top of an adjacent upright cylindrical female element 26, as shown by the arrows in FIG. 4, causing each upright cylindrical female element 26 to receive upright cylindrical male element 24 in snap engagement, as shown in FIG. 5. For purposes of illustration, indented surfaces 40 and 42 are shown as arcuate surfaces. However, those skilled in the art will realize that a variety of shapes in these indented surfaces 40 and 42 are practical.

When one wants to lock the lid 12 over the tray 16, one inserts all upright cylindrical male elements 24 into their corresponding upright cylindrical female elements 26. He places his thumb over the upright cylindrical female elements 26 and the raised lands 28 and his forefinger at a position on the horizontal flange 20 under an upright cylindrical male element 24. He then squeezes his thumb against his forefinger thereby engaging the upright cylindrical male and female elements 24, 26 into snap engagement. As the user presses on a combination of the female elements 26 and raised lands 28, the depth of depression of the thumb into the interlocked male and female elements 24, 26 is limited by contact with the raised lands 28. This prevents the deformation of the male and female elements 24, 26 after repeated use, thereby increasing the durability, reusability and lifetime of the locking mechanism of the food tray 10.

Figure 6:
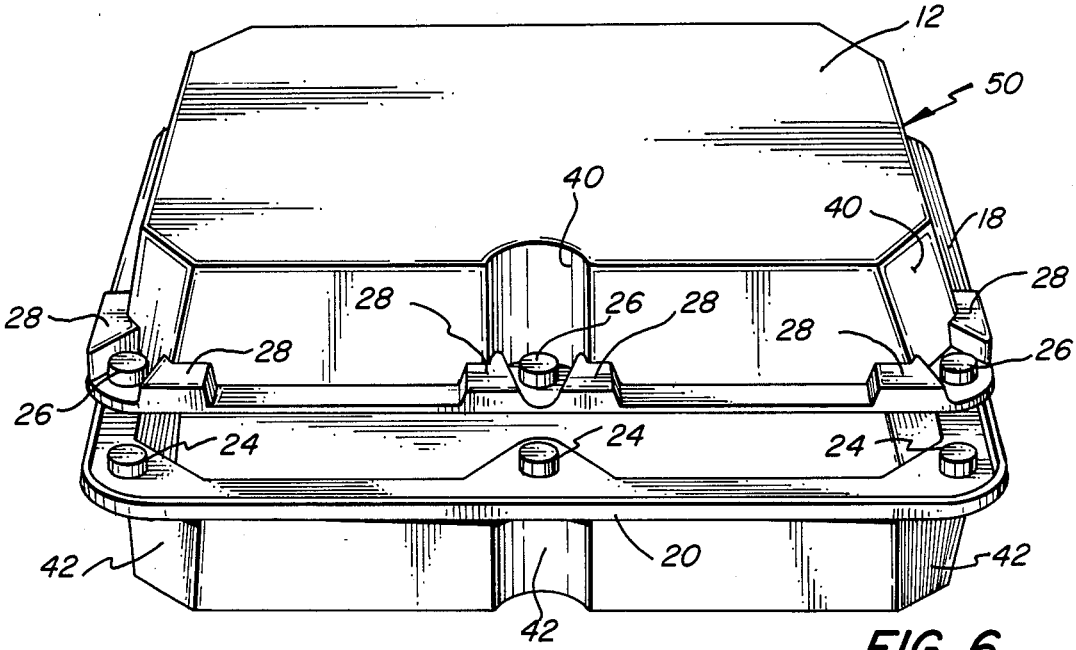
FIG. 6 is a perspective view of another form of food tray of the present invention.
Figure 3:
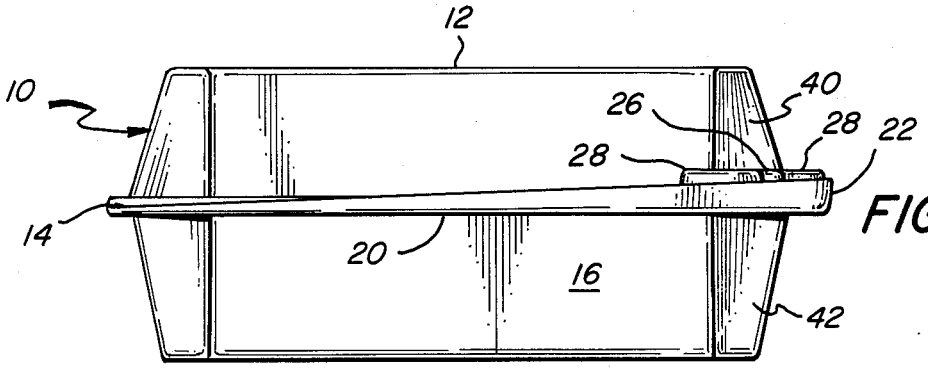
FIG. 3 is a side plan view of the lidded food tray of FIG. 1 after it has been closed and locked as seen from the left hand side of FIG. 2.

Tray 50, shown in FIG. 6, has a similar locking mechanism to that of tray 10, the same numerals indicating the same elements. The tray 50, however, is larger than tray 10, being rectangular rather than square, and has a center, as well as end interlocking, snap closure elements 24, 26 with adjacent lands 28.

What is claimed is:

1. A container for carrying food comprising:

a tray portion, a lid portion directly hinged to the rear of said tray portion for movement towards and away from said tray portion to open and close the same, and means for locking said lid portion to said tray portion, said locking means including:

a horizontal flange extending around the periphery of said tray portion, a horizontal flange extending around the periphery of said lid portion adapted to be seated on the horizontal flange of said tray portion, one or more upright male elements extending upwardly from said horizontal flange on said tray portion towards said lid portion, one or more upright female elements extending upwardly from said horizontal flange on the periphery of said lid portion in positions corresponding to those of said one or more upright male elements, each of said one or more female elements receiving one of said one or more upright male elements in interlocking engagement as said lid portion is folded over said tray portion in a closed position, and raised lands extending upwardly from said horizontal flange on the periphery of said lid portion and being discrete from said one or more female elements, said lands being provided on opposite sides of and adjacent to each of said one or more upright female elements on said horizontal flange of said lid portion.

2. The container of claim 1 wherein said upright male elements and said upright female elements are substantially cylindrical.

3. The container of claim 1 including an indented surface in both said lid portion and said tray portion adjacent to each corresponding pair of said raised lands and upright female elements.

4. The container of claim 1 wherein said flange on said tray portion includes an upstanding wall about its periphery, opposite portions of said upstanding wall being spaced a slightly smaller distance than corresponding portions of said flange on said lid portion.

5. The container of claim 1 wherein said lid portion and tray portion are thermoformed from plastic in one integral piece.

6. The container of claim 1 wherein said lid portion and tray portion are substantially square in plane elevation and said male and female elements are located at opposite front corners of said lid and tray portion flanges.

7. The container of claim 1 wherein said lid portion and tray portion are substantially rectangular in plane elevation and said male and female elements are located at opposite front corners and in the center of said lid and tray portion flanges.

8. The container of claim 1 wherein said male and female upright elements are cylindrical in shape.

9. The container of claim 1 wherein said raised lands extend upward from said horizontal flange substantially the same distance as said one or more upright female members adjacent to which said raised lands are provided on opposite sides thereof.

10. A container for carrying food comprising:

a tray portion, a lid portion directly hinged to the rear of said tray portion for movement towards and away from said tray portion to open and close the same, and means for locking said lid portion to said tray portion, said locking means including:

a horizontal flange extending around the periphery of said tray portion, a horizontal flange extending around the periphery of said lid portion adapted to be seated on the horizontal flange of said tray portion, one or more upright male elements extending upwardly from said horizontal flange on said tray portion towards said lid portion, one or more upright female elements extending upwardly from said horizontal flange on the periphery of said lid portion in positions corresponding to those of said one or more upright male elements, each of said one or more female elements receiving one of said one or more upright male elements in interlocking engagement as said lid portion is folded over said tray portion in a closed position;

means extending upwardly from said horizontal flange on the periphery of said lid portion and being discrete from said one or more upright female elements for pressing in combination with said one or more upright female elements when locking the lid portion to the tray portion, said upwardly extending discrete means being provided on opposite sides of said one or more upright female elements to limit the deformation of the interlocking upright male and female elements; and said upwardly extending means further comprising raised lands being spaced apart from said one or more female elements, said lands being provided on opposite sides of and adjacent to each of said one or more upright female elements on said horizontal flange of said lid portion.

11. The container of claim 10 wherein said raised lands are approximately the height of said one or more female elements.

12. The container of claim 10 wherein said upright male elements and said upright female elements are substantially cylindrical.

* * * * *